United States Patent [19]

Vollhardt et al.

[11] Patent Number: 4,522,155

[45] Date of Patent: Jun. 11, 1985

[54] METHOD AND APPARATUS FOR CONTROLLING THE HEATING EFFECT OF HIGH TEMPERATURE GASES TO BE SUPPLIED TO A HEAT EXCHANGER

[75] Inventors: Frohmut Vollhardt, Siegen-Bürbach; Heinz Haacker, Kreuztal-Ferndorf, both of Fed. Rep. of Germany

[73] Assignee: M.A.N. Maschinenfabrik Augsburgg-Nürnberg Aktiengesellschaft, Fed. Rep. of Germany

[21] Appl. No.: 381,748

[22] Filed: May 25, 1982

[30] Foreign Application Priority Data

May 29, 1981 [DE] Fed. Rep. of Germany ..... 3121297

[51] Int. Cl.[3] ..... F22B 1/00

[52] U.S. Cl. ..... 122/7 R; 122/32; 165/1

[58] Field of Search ..... 122/7 R, 7 A, 32, 33; 165/1, 107 D

[56] References Cited

U.S. PATENT DOCUMENTS 4,098,324 7/1978 Kummel ..... 122/7 R 4,352,341 10/1982 Styslinger ..... 122/7 R

*Primary Examiner*—Edward G. Favors

*Attorney, Agent, or Firm*—McGlew and Tuttle

[57] ABSTRACT

A method of controlling the heating effect of high temperature gases such as gases obtained in the partial oxidation of oil asphalt, oil shale or coal and the like which are to be used for the heating of another media such as for superheating steam comprises passing the high temperature gases into a space on the way to the heating of the media and circulating a heat absorbing media such as water into the space in quantities to have a selected heat exchange with the high temperature gases and control the temperature thereof on its way to its use in a heat exchanger or superheater. The apparatus include a vessel which is connected between a superheater and a steam producing gas cooler which has an inlet for the high temperature gases which are circulated through the vessel through tubes on its way to the superheater which is disposed over the vessel and advantageously connected to it. The temperature of the high temperature gases which are circulated through the vessel is controlled by the selected admission of an additional heat absorption media such as water into the vessel which may be carried out to the point where the water encompasses the tubes and provides a cooling effect thereon.

17 Claims, 1 Drawing Figure

METHOD AND APPARATUS FOR CONTROLLING THE HEATING EFFECT OF HIGH TEMPERATURE GASES TO BE SUPPLIED TO A HEAT EXCHANGER

FIELD AND BACKGROUND OF THE INVENTION

The invention relates in general to heat exchangers and in particular to a new and useful method for controlling the heat of heat yielding gases to be supplied to a heat exchanger, and to an apparatus for the practice of this method.

In the cooling of gases obtained under gas side pressure and at high temperatures, as e.g. in the partial oxidation of oil, asphalt, oil shale or coal, the gases are laden with pollutants which lead to high or low temperature corrosion. By German Pat. Nos. 1,918,171 and 1,751,085 waste heat boilers have been proposed whereby it is possible to generate high pressure steam at smallest tube wall overtemperature while yet remaining below the high temperature corrosion limit.

As the gases are laden with amorphous soot or coke and ash particles, the heat transfer of the waste heat boiler becomes worse with increasing fouling. To counteract this, the exchanger surfaces of the boiler have been made oversize in order to have large reserves available and to achieve a long period of use between two cleaning periods. Another option is to use special cleaning possibilities, e.g. variation of the gas velocity during the operation itself.

With certain heat exchangers, e.g. with superheaters, in like manner corrosion occurs below a certain tube wall temperature making it necessary to control and to influence this tube wall temperature during operation, without the continuous operation of the installation being impaired. But if e.g. a saturated steam generator is followed by a superheater, it is not possible to provide heating surface reserves in the vaporization zone, because if the gas is cooled too much, the desired hot steam temperature is no longer obtainable.

SUMMARY OF THE INVENTION

The invention provides a method and an apparatus by which the heat of heat yielding gases is controllable during running operation so easily and without any great technical expense that the disadvantages of high temperature corrosion do not occur and expensive means e.g. a heating surface enlargement as exchanger reserve can be obviated. Also with the invention variations of the gas velocity during operation are avoided.

In accordance with the method of the invention the heating effect of high temperature gases which are to be used for the heating of another media is controlled by passing the high temperature gases into a space on the way to the heating of the other media and circulating a heat absorbing media into the space in a quantity to cool the high temperature gases to a predetermined amount. The apparatus employed in accordance with the invention comprises a vessel which has an inlet for the high temperature gases and a tubular passage in the form of a heat exchanger disposed in the vessel connected between the inlet and a discharge to the additional heater. The heat absorbing media such as water is circulated into the vessel in a quantity such that it will flow to a depth to encompass a portion of the tubes when it is desired to heat the high temperature gases to a controlled amount.

An advantage of the apparatus according to the invention is that, by simple control of the quantity of liquid, generally water, in the apparatus, the heat of the heat yielding medium i.e. of the gases, can be varied quickly and without problem. All that is necessary is to reduce or increase the quantity of the liquid bath in the apparatus by the adjustment of a control valve or of a pump. Of special advantage is the application of the method in an apparatus in conjunction with a preceding waste heat boiler and a following superheater. An advantage in terms of space results when the apparatus according to the invention forms a structural unit with a superheater and is separated from the superheater. It is separated from the superheater in principle only be a pressureless intermediate bottom in a one-part or multipart housing.

Accordingly, it is an object of the invention to provide a method of controlling the heating effect of high temperature gases which are to be used for the heating of another media which comprises passing the high temperature gases into a space on their way to the heating of the media and circulating heat absorbing media into the space in a quantity to cool the high temperature gases to a predetermined amount.

A further object of the invention is to provide a device for controlling the heating effect of high temperature gases which are to be used for the heating of another media in a separate heat exchanger which comprises a vessel which has an inlet for the high temperature gases and a tubular conduit forming a heat exchanger in a portion of the interior of the vessel which has a discharge for the high temperature gases to the heater or further heat exchanger and which includes means for circulating a controlled quantity of heat absorbing media into the vessel to control the temperature of the high temperature gases.

A further object of the invention is to provide a device for controlling the heating effect of high temperature gases which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The only FIGURE of the drawings is a schematic sectional view of an apparatus having a device for controlling the heating effect of the high temperature gases constructed in accordance with the invention.

DESCRIPTION OF THE PREFERRED EMBODIMENT

Figure 1:
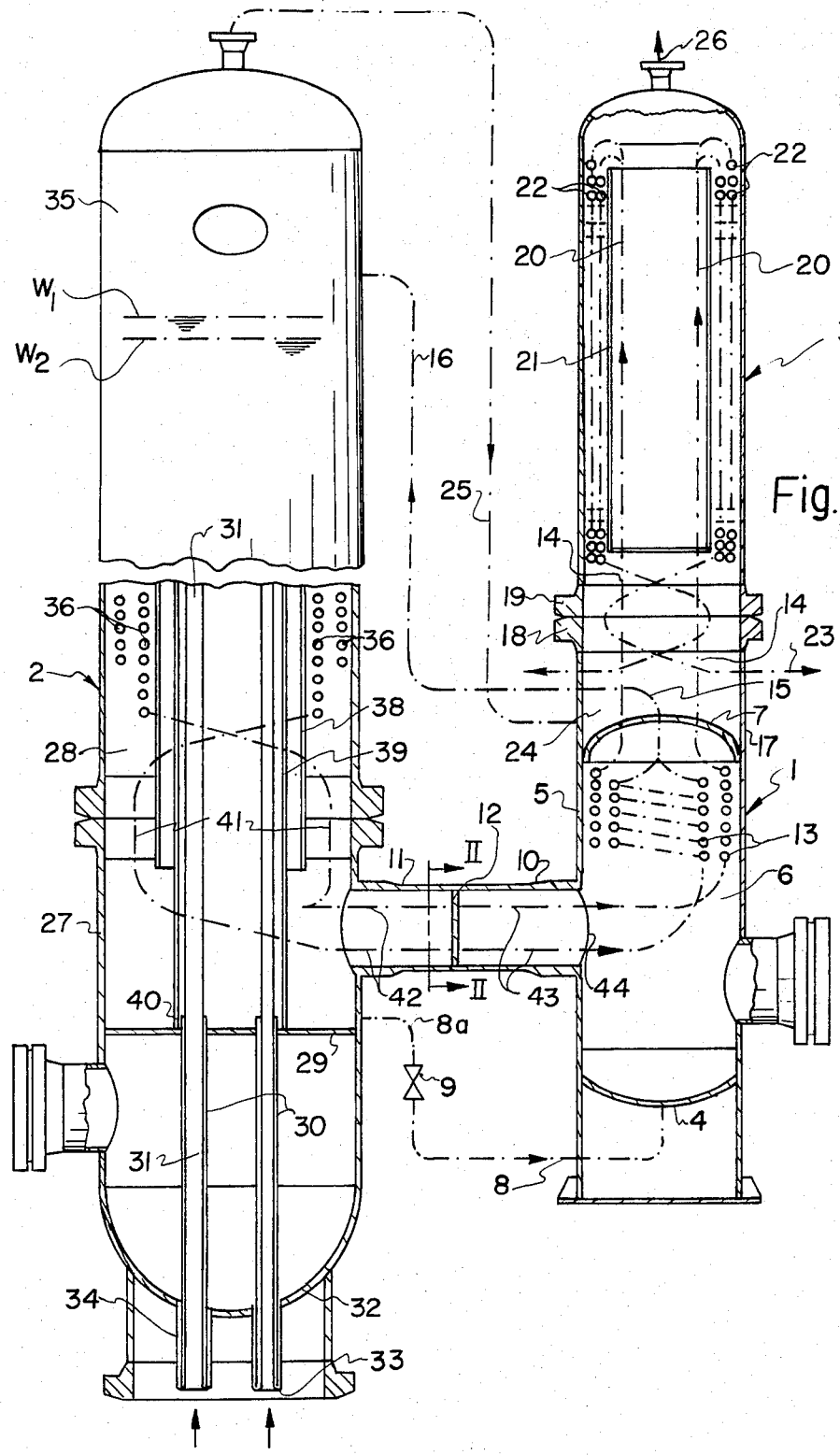

Referring to the drawing in particular the invention embodied therein comprises a method of controlling the heating effect of high temperature gases such as the high temperature gases which follow a saturated steam producing gas cooler 2 which are to be used for heating of another media such as steam in a superheater 3. The high temperature gases are passed through an inlet opening 44 of a vessel, or apparatus 1 which has spiral tubes forming a passage for the high temperature gas through the vessel and a steam discharge line 15 which forms a gas cooler feed line 16 which passes through the steam producing gas cooler 2 and is discharged therefrom through a line 25 to the superheater 3. The heat absorbing media or coolant such as water is passed through a water feed line 8 into the vessel 1 in a quantity to cool the high temperature gases to a predetermined amount.

The apparatus 1 according to the invention is connected on the gas side to follow a saturated steam producing gas cooler 2, as known for example from German Pat. No. 1,918,171 and to precede a superheater 3 on the gas side. Its cylindrical jacket 5 provided with a bottom 4 surrounds a water-steam space 6, which is closed off toward the top by a pressureless top wall or arched bottom 7. Into the bottom 4 opens a liquid feed line, in the present case a water feed line 8, in which a valve 9 is inserted. In addition to or instead of the valve 9, a circulating or feed pump may be installed in the line section 8*a*.

Approximately at mid-height of the water-steam space 6 a pipe piece 10 opens into it, in which there extend axially, as can be seen from the FIGURE, several, in the illustrated case four, gas carrying tubes 43 which traverse a dividing wall 12 which extends across the cross-section of the pipe piece 10 and closes off the cross-section, of a connecting pipe piece 11 which forms a part of the gas cooler that generates saturated steam.

The gas carrying tubes 43 terminate in spiral or coiled tubes 13, which at their upper end open into transfer pipes 14. The upper bottom 7 of the water-steam space 6 has a preferably centered steam discharge line 15, which changes over into a feed line 16 of the gas cooler 2.

The cylindrical jacket 5 of the apparatus 1 is extended in a cylindrical jacket portion 17, on the flange 18 of which the flange 19 of the super heater 3 is placed. The transfer pipes 14 in the cylindrical jacket section 17 change over into a nest of straight tubes 20 in the superheater 3, which are arranged inside a cylindrical apron 21 and which at their upper end reverse their direction and terminate in spiral tubes 22 of the superheater. The lower end of these spiral tubes opens into the gas outlet pipes 23, through which the cooled gas leaves the superheater.

In the space 24 above the bottom 7 there opens the saturated steam line 25 of the gas cooler 2. Having passed through the superheater 3 situated directly above the space 24, the steam leaves the entire apparatus in the direction of arrow 26.

The gas cooler 2 preceding the apparatus 1 on the gas side has a cylindrical jacket 27 which surrounds the water-steam space 28 and which is limited downwardly by the intermediate bottom 29, into which are fitted the upper ends of the outer tubes 30 arranged circularly around the central axis M of the gas cooler, into which (tubes) the lower end of the gas carrying pipes 31 projects. Both pipes pass through the lower bottom 32 of the gas cooler, the inner gas carrying pipes 31 being connected with the outer tubes 34 via collars 33, a space being left between the lower end of the inner tubes 31 and the collar 33.

In the upper section of the water-steam space 28, in which the water stands below the saturated steam space 35 (cf. water levels $W_1$, $W_2$) spiral tubes 36 surround an outer apron 38, which in turn concentrically surrounds a further apron 39 in spaced relation, the lower end 40 of which rests on the intermediate bottom 29. These spiral tubes 36 terminate in the upper portion of the gas cooler in the upwardly tapering inner gas carrying pipes 31 and communicate via the feed pipes 41 with the line sections 42 of the pipe piece 11 and hence with the gas-carrying pipes 43 of the spiral tubes 13 of the apparatus 1 of the invention.

As the FIGURE indicates, the feed line 16 for the steam coming out of space 6 of apparatus 1 discharges into the saturated steam space 35 of the gas cooler 2, while saturated steam from this space passes via line 25 into space 24 above the pressureless bottom 7, superheats in the superheater 3, and issues therefrom at 26.

To be able to vary the temperature of the gases issuing from the gas cooler 2, the water level in space 6 is regulated by the valve 9 and/or by the circulating or feed pump (not shown). If the water level is below the inlet opening 44 of the pipe piece 10 and hence of the tubes 43 in apparatus 1, cooling of the gases does not take place; rather, the gases pass uncooled into the tubes 20 of the superheater 3. If the water level in space 6 is chosen just above tubes 43, less heat transfer takes place from the gases in the spiral tubes 13 than when space 6 is filled with water more or completely. Thus, without creating a large reserve exchanger surface, by the cooling agent, in the form of the water bath in the water space 6, a regulation of the heat of the gases entering the superheater 3 is created, with the additional advantage that the steam generated in the apparatus 1 can be utilized.

While a specific embodiment of the invention has been shown and described in detail to illustrate the application of the principles of the invention, it will be understood that the invention may be embodied otherwise without departing from such principles.

What is claimed is:

1. A heat exchanger device comprising a steam producing gas cooler having a water steam space therein and a tubular conduit for the passage of high temperature gases therethrough, a vessel having a bottom wall with an inlet above said bottom wall connected to the high temperature gases of said steam producing gas cooler, said vessel having a tubular portion for the high temperature gases connected from said inlet to a discharge, a liquid connection from said steam producing gas cooler to the bottom of said vessel, means in said liquid line for controlling the amount of liquid passed into said vessel, the inlet for said high temperature gas being located above the bottom of said vessel and a superheater disposed over said vessel and having a tubular connection therein for the passage of the high temperature gases from said vessel through said superheater.

2. A device according to claim 1, wherein the connection between said steam producing gas cooler and said vessel includes a pipe piece on each of said vessel interconnecting each other and having a dividing wall therebetween through which the tubes for the high temperature gases pass.

3. A device according to claim 2, wherein said superheater in said vessel are separated by a top wall bottom.

4. A device according to claim 3, including a connection from said vessel discharge for the high temperature gases to said steam producing gas cooler for circulating said high temperature gases through a saturated steam space of said cooler and an additional connection from said cooler to said superheater to circulate the high temperature gases after they are passed through the saturated stream space through the superheater.

5. A method of controlling the heating effect of high temperature gases which are to be used for the heating of another media, comprising passing the high temperature gases into a space on their way to the heating of the other media and circulating a heat absorbing media into the space in a quantity to cool the high temperature gases to a predetermined amount, the high temperature gases being passed through a vapor producing gas cooler and directed into a separate vessel through tubes forming a heat exchanger in said vessel, said heat absorbing media comprising a vaporizable liquid circulated from said vapor producing gas cooler to said vessel.

6. A method according to claim 1, wherein said vaporizable liquid comprises water, said vapor producing gas cooler producing steam.

7. A method according to claim 6, wherein said vessel has a lower bottom with an opening for circulating the water therethrough as an inlet for the high temperature gases at a spaced location above said bottom, said high temperature gases extending through said vessel in a spiral tube and wherein the water is circulated up to a point where it encompasses said tube for cooling said high temperature gases.

8. A method of controlling the heat of a high temperature gas which is to be used for heating another media in a heat exchanger (3), comprising:

precooling the high temperature gas in a gas cooler (2) which produces the other media as vapor of a vaporizable liquid;

supplying the precooled high temperature gas to an intermediate vessel (1) which is capable of further cooling the precooled high temperature gas by a controlled extent;

supplying a coolant to said intermediate vessel to fill said intermediate vessel to a selected level with respect to a path of the precooled high temperature gas passing through said intermediate vessel; and supplying the precooled high temperature gas from said intermediate vessel to the heat exchanger (3).

9. A method according to claim 8, wherein said coolant comprises the vaporizable liquid and is supplied from said gas cooler to said intermediate vessel.

10. A method according to claim 9, wherein said other media comprises steam, the vaporizable liquid comprising water.

11. A device for controlling the heating effect of high temperature gas which is to be used for heating the vapor of a vaporizable liquid, comprising:

a gas cooler for precooling the high temperature gas, for containing the vaporizable liquid and for producing vapor from the vaporizable liquid as a result of the precooling of the high temperature gas;

an intermediate vessel connected to said gas cooler having a gas pathway therein for receiving precooled high temperature gas from said gas cooler and a space for receiving vaporizable liquid from said gas cooler over a liquid supply line;

a heat exchanger connected to said intermediate vessel and to said gas cooler for receiving vapor of said vaporizable liquid from said gas cooler and for receiving precooled high temperature gas from said gas pathway in said intermediate vessel; and vaporizable liquid quantity control means connected to said liquid supply line for controlling an amount of vaporizable liquid in said intermediate vessel space for controlling the amount of cooling of said precooled high temperature gas in said intermediate vessel.

12. A device according to claim 11, wherein said vaporizable liquid quantity control means comprises a volume control valve in said supply line for controlling a level of liquid in said intermediate vessel space.

13. A device according to claim 11, wherein said gas pathway comprises a heat exchanger coil in said intermediate vessel, said heat exchanger comprising a superheater and having a heat exchanger pipe extending therein and connected to said heat exchanger foil.

14. A device according to claim 13, including a communicating conduit connected between said gas cooler and said intermediate vessel for communicating a space of said gas cooler which contains the vaporizable liquid with the space of said intermediate vessel, a partition extending across said communicating conduit, a precooling gas pipe in said gas cooler and a communicating gas pipe connected between said precooling gas pipe and said heat exchanger foil, said communicating gas pipe extending in said communicating conduit and through said partition so as to be exposed to vaporizable liquid in said communicating conduit.

15. A device according to claim 11, wherein said gas cooler includes a vapor space for containing the vapor above the vaporizable liquid, a vapor supply line connected between said intermediate vessel space and said vapor space for supplying vapor from said intermediate vessel to said vapor space and a return vapor line connected between a top of said vapor space and said heat exchanger for supplying vapor from said vapor space to said heat exchanger.

16. A device according to claim 11, wherein said heat exchanger and said intermediate vessel are connected to each other with said heat exchanger above said intermediate vessel and a common intermediate bottom connected between said heat exchanger and said intermediate vessel for separating the spaces of said heat exchanger and intermediate vessel.

17. A device according to claim 16, wherein said heat exchanger and intermediate vessel form a single structural unit.

* * * * *